United States Patent [19]

Emerson

[11] Patent Number: 4,461,589

[45] Date of Patent: Jul. 24, 1984

[54] MARKER APPARATUS WITH SHARPENER

[76] Inventor: Clarence A. Emerson, 203 E. Birch, P.O. Box 1687, Bozeman, Mont. 59715

[21] Appl. No.: 396,801

[22] Filed: Jul. 9, 1982

[51] Int. Cl.[3] ..... B43K 29/06

[52] U.S. Cl. ..... 401/50; 145/3.61; 401/93

[58] Field of Search ..... 401/50, 51, 93, 82; 145/3.1-3.9

[56] References Cited

U.S. PATENT DOCUMENTS

| | | | |
|---|---|---|---|
| 33,034 | 8/1861 | Faber | 401/93 |
| 179,641 | 7/1876 | Batchelder | 145/3.61 X |
| 775,097 | 11/1904 | Trump | 401/93 |
| 786,130 | 3/1905 | Makant | 401/82 |
| 823,706 | 6/1906 | Stahle | 401/82 |
| 1,210,506 | 1/1917 | McDonald | 145/3.61 |
| 1,428,188 | 9/1922 | Smoot | 401/82 |
| 2,134,570 | 10/1938 | Meilner | 401/50 X |
| 2,143,797 | 1/1939 | Powell | 145/3.61 |
| 3,756,727 | 9/1973 | Gallagher | 401/82 X |

FOREIGN PATENT DOCUMENTS

| | | | |
|---|---|---|---|
| 1016386 | 11/1952 | France | 145/3.5 |
| 467115 | 11/1951 | Italy | 401/51 |
| 97657 | 2/1923 | Switzerland | 145/3.61 |
| 7985 | of 1910 | United Kingdom | 401/50 |

*Primary Examiner*—Steven A. Bratlie

*Attorney, Agent, or Firm*—Arthur L. Urban

[57] ABSTRACT

Marker apparatus including a body portion, a marking portion, a retainer portion and a sharpening portion; the body portion including an elongated tubular member, the tubular member including a substantially straight passage therethrough; the marking portion including a substantially straight marking stick formed of soft material, the marking stick having a substantially circular cross section; the retainer portion including mechanism for exerting transverse pressure on the marking stick, the pressure exerting mechanism being disposed adjacent one end of the body portion; the sharpening portion including a clip member disposed on the body portion adjacent the end thereof remote from the end adjacent the retainer portion, the clip member including an arcuate section having substantially the same configuration as a portion of the cross section of the tubular member, flange sections extending inwardly from adjacent the ends of the arcuate section, the flange sections extending through slots in the sidewall of the tubular member; the flange sections including cutting sections diverging toward the free end of the tubular member; whereby an end of the marking stick can be sharpened by removing the stick from the tubular member, inserting one end of the marking stick into the end of the tubular member adjacent to the sharpening portion and rotating the stick with respect to the tubular member to cause the end of the stick to be sharpened as it contacts the diverging cutting sections.

10 Claims, 5 Drawing Figures

MARKER APPARATUS WITH SHARPENER

This invention relates to a novel marker apparatus and more particularly relates to a new apparatus for holding a marker.

Markers have been used throughout the ages. Originally, markers were pieces of natural materials such as coal, stone, inks from plant materials and the like. Some marker materials commonly were used as they were found. With other marking substances, the materials might be mixed or dissolved in water to make their use more convenient.

As civilization developed, it was found that the natural marker materials were not satisfactory in all situations. As a result, some natural materials were modified to render them more convenient for use. An example of such a modified material is chalk which is frequently pressed into sticks. Another example is pencil lead which is graphite formed into a stick and inserted into a wooden cylinder. Also, synthetic materials such as inks and the like were developed for special uses.

One of the problems encountered with marker materials is the fact that the material not only marks the desired surface but also the material discolors any other surface with which it comes into contact. The user's hands, clothing and the like become discolored. While the user can use a high degree of care with the marker material to avoid accidental contact with surfaces, the method employed in its application might require that there be some contact with surrounding surfaces.

Solid markers ordinarily are handled directly so that the material rubs off onto the hands. If the material is easily removable from the hands, most users do not bother to protect their hands but simply clean their hands after using the marker. If the material cannot be removed from the hands easily, many people try to use some protective surface on their hands or on the marker material.

Cases, sheaths, coverings and the like have been developed to protect the user from the marking material. Sometimes cases are required to reduce the incidence of breakage of the marker material. As more and more different markers have become available in recent years, the protective cases and coverings for the markers also have become more individualized.

One type of marker which commonly has been used with a holder is soapstone that is used to mark metal for welding, cutting, bending and the like. U.S. Pat. No. 3,756,727 is directed to one form of holder for soapstones with rectangular cross sections. The patent describes a holder which utilizes an indexing member that slides along an elongated receptacle. The receptacle has top flanges with openings along their length. The indexing member has a pair of projecting elements that are selectively engageable with one pair of the openings. Movement of the indexing member is effected by depressing a portion of the indexing member which projects between the flanges.

While the device of the above patent provides a holder for a flat soapstone stick, the holder may present problems in use. The design of the indexing member may allow it to be activated accidentally at the wrong time. This may occur when the apparatus is being handled or even when it is in a pocket.

Another problem with most marker holding apparatus is the difficulty in keeping the marker sharpened. When the marker becomes dull, the user may continue to use it in spite of the dull surface. Alternatively, the user may sharpen the marker with a knife or by rubbing one side against some rough surface.

Although this sharpening method may produce a satisfactory point in some situations, the necessity for having a knife or a roughened surface close by may be inconvenient and bothersome. In order to insure that the sharpener is handy and does not interfere with the work being done, many workmen will place the sharpener in a pocket. However, this requires extra effort by the worker to fumble through his pocket, find it, remove it from the pocket, use it and then return it to a pocket. All of this activity takes time and reduces the worker's efficiency and productivity.

From the above discussion, it is clear that present markers do not provide desired results in many situations. Thus, there is a need for a new marker apparatus that overcomes the problems of current markers.

The present invention provides a novel marker apparatus that facilitates maintenance of a sharpened point. The marker apparatus provides a convenient location for the sharpener so that it is always available for use. Also, the apparatus can be used and stored safely without the hazard of accidentally cutting a finger or other material.

The marker apparatus of the invention minimizes accidential movement of the marker therein. The marker apparatus of the invention is slim in profile and can be carried conveniently in a pocket without significant bulging. The apparatus is capable of holding even short pieces of the marker so that waste is minimized.

The marker apparatus of the invention is simple in design and relatively inexpensive. The apparatus can be fabricated from commercially available materials and components. Conventional tool manufacturing procedures and techniques may be utilized in the fabrication. The marker apparatus is durable in construction and has a long useful life.

The apparatus of the invention is convenient to use with a minimum of instruction. A marker stick can be inserted into the holder easily and quickly.

Other benefits and advantages of the novel marker apparatus of the present invention will be apparent from the following description and the accompanying drawings in which.

Figure 1:
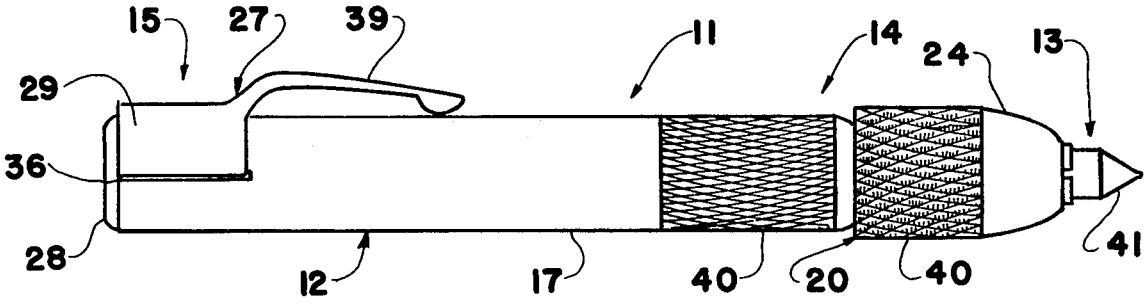
FIG. 1 is a side elevation of one form of the marker apparatus of the invention.
Figure 2:
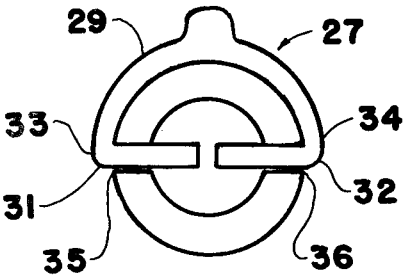
FIG. 2 is a left end view of the marker apparatus shown in FIG. 1.
Figure 4:
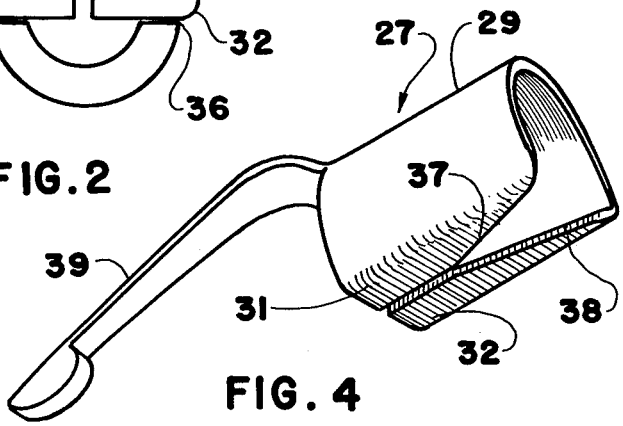
FIG. 4 is a view in perspective of the clip member of the marker apparatus.
Figure 3:
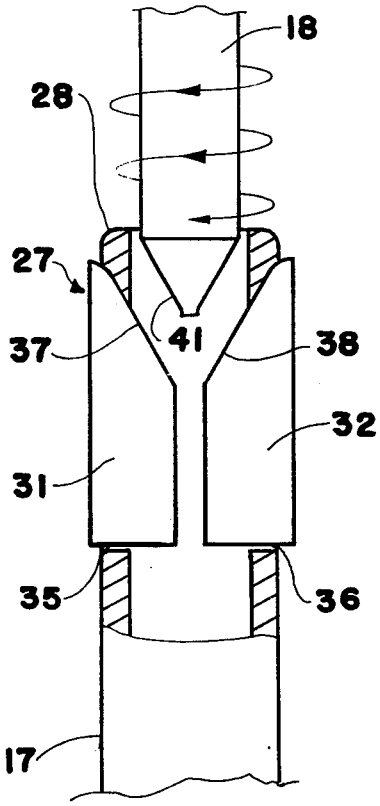
FIG. 3 is a sectional view of the sharpening portion of the marker apparatus.

As shown in the drawings, one form of the novel marker apparatus 11 of the present invention includes a body portion 12, a marking portion 13, a retainer portion 14 and a sharpening portion 15. The body portion 12 of the marker apparatus 11 includes an elongated tubular member 17. The tubular member 17 includes a substantially straight passage therethrough.

The marking portion 13 of the marker apparatus 11 of the invention includes a substantially straight marking stick 18. The marking stick 18 has a substantially circular cross section. The marking stick 18 is formed of soft material. One particularly useful stick material is soapstone. Soapstone is commonly used for the marking of metal surfaces.

Figure 5:
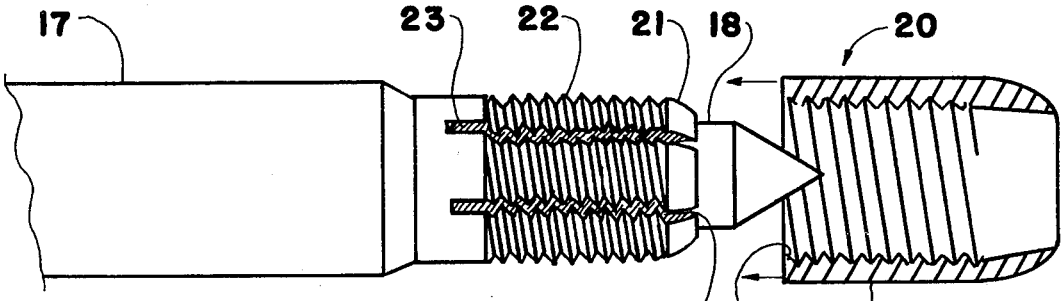
FIG. 5 is a sectional view of the retainer portion of the marker apparatus.

The retainer portion 14 of the marker apparatus 11 includes means 20 for exerting transverse pressure on the marking stick 18. The pressure exerting means 20 is disposed adjacent one end 21 of the tubular body portion 12. The pressure exerting means 20 advantageously exerts pressure around substantially an entire circumferential section of the marking stick 18. This may be accomplished with the construction shown in detail in FIG. 5.

As shown in the drawings, the tubular member 17 includes an externally threaded section 22 adjacent the end 21 thereof. Also, the end 21 includes a plurality of longitudinal slots 23 in connection with the threaded section 22.

A sleeve member 24 of a size slightly larger than the end 21 of the tubular member 17 is associated therewith. The sleeve member 24 includes an internally threaded surface 25 that is engageable with the externally threaded section 22 of the tubular member 17. Threading the sleeve member 24 along the threaded section 22 of the tubular member 17 compresses the slotted end 21 thereof against the marking stick 18 disposed in the tubular member to provide secure engagement therewith.

The sharpening portion 15 of the marker apparatus 11 of the invention includes a clip member 27. The clip member 27 is disposed on the body portion 12 adjacent the end 28 thereof remote from the end 21 that is adjacent to the retainer portion 14. The clip member 27 includes an arcuate section 29. The arcuate section 29 has a configuration that is substantially the same as that of a portion of the cross section of the tubular member 17.

Flange sections 31 and 32 extend inwardly from adjacent ends 33 and 34 of the arcuate section 29. The flange sections 31 and 32 extend through slots 35 and 36, respectively, of the tubular member 17. The flange sections include cutting sections 37 and 38. The cutting sections diverge toward the free end 28 of the tubular member 17. The flange sections 31 and 32 preferably are disposed in substantially the same plane.

The clip member 27 advantageously also includes a finger section 39. The finger section 39 extends from the arcuate section 29. The finger section 39 is disposed longitudinally of the tubular member 17. The finger section extends from the arcuate section 29 toward the retainer portion 14. The finger section 39 of the clip member 27 preferably is biased toward the tubular member 17.

The marker apparatus 11 of the invention may be fabricated from any of a variety of different materials such as metals, plastics and the like. The clip member 27 advantageously is formed of metal strip. The body portion 12 and the retainer portion 14 also may be formed of a metal such as aluminum or may be formed of a plastic material. Advantageously, at least one of the body portion 12 or the retainer portion 14 includes a gripping surface 40 along the length thereof.

The marker apparatus 11 shown in the drawings is assembled for use by attaching the sharpening portion 15 on end 28 of the body portion 12. This may be accomplished by positioning the finger section 39 of the clip member 27 over the tubular member end 28, aligning the flange sections 31 and 32 with the slots 35 and 36 and sliding the flanges into the slots until the free end of the arcuate section 29 is aligned with the end 28 of the tubular member 17.

Next, a marking stick 28 is sharpened by placing an end thereof into the end 28 of the tubular member 17 and pushing it into contact with the sharpening portion 15. The stick 18 then is rotated with respect to the tubular member 17 causing the cutting sections 37 and 38 which form a Vee configuration to remove the peripheral material of the stick 18 until a point 41 is formed in the end of the stick.

The sharpened marking stick 18 then is inserted into the tubular member 17 with the pointed end 41 extending outwardly from the end 21. Thereafter, sleeve member 24 is slipped over the exposed pointed end of the marking stick 18. The sleeve 24 is threaded onto the threaded section 22 of the tubular member until the stick is held firmly in position. The marker apparatus 11 now is ready for use.

The marker apparatus 11 of the invention can be used in a conventional manner to mark surfaces. With a soapstone marking stick, the marker apparatus is particularly useful for marking metal surfaces such as pieces to be welded, bent, cut or a similar metal working operation. Continued use of the marker apparatus causes the soft marking stick to wear away.

When the marking stick 18 becomes dull and needs to be sharpened, the sharpening can be accomplished easily and quickly by loosening the sleeve 24 from the tubular member 17. This action allows the marking stick 18 to be removed from the tubular member 17.

The sharpening can be performed by inserting the end of the stick 18 into the sharpening portion 15 again and repeating the rotation thereof with respect to the tubular member 17. When the sharpening is completed, the stick is replaced in position with the tubular member and the sleeve 24 tightened again to secure the stick in place. The sharpening operation can be repeated frequently or occasionally as desired with a minimum of disruption of the user's normal tasks.

The above description and the accompanying drawings show that the present invention provides a novel marker apparatus with advantages not found in previous markers. The marker apparatus of the invention enables a workman to maintain a sharp point on the marker simply and conveniently. Marking sticks can be removed for sharpening and replaced easily and quickly with a minimum of disruption of the user's normal tasks.

Since the sharpener is an integral part of the marker apparatus of the invention, the sharpener is always available for use. This construction avoids the problems inherent in separate sharpeners that must be stored when not in use but yet must be readily available to perform the sharpening operation.

The marker apparatus of the invention is simple in design and can be fabricated relatively inexpensively. The design of the sharpening portion of the apparatus provides for safe use and storage without the hazard of accidentally cutting a finger or other material.

The marker apparatus can be fabricated from commercially available materials and components. Conventional tool manufacturing techniques and procedures can be employed in its manufacture. The apparatus is durable in construction and has a long useful life.

It will be apparent that various modifications can be made in the particular marker apparatus described in detail above and shown in the drawings within the scope of the invention. The size, configuration and arrangement of components can be changed to meet specific requirements. Also, the external parts of the sharpening portion can be different provided the functioning and operation of the marker apparatus are not adversely affected. Therefore, the scope of the invention is to be limited only by the following claims.

What is claimed is:

1. Marker apparatus including a body portion, a marking portion, a retainer portion and a sharpening portion; said body portion including an elongated tubular member, said tubular member including a substantially straight passage therethrough; said marking portion including a substantially straight marking stick formed of soft material, said marking stick having a substantially circular cross section; said retainer portion including means for exerting transverse pressure on said marking stick, said pressure exerting means being disposed adjacent one end of said tubular member; said sharpening portion including a removable clip member diposed on said tubular member adjacent an open end thereof remote from the end adjacent said retainer portion, said clip member including an arcuate section having substantially the same configuration as a portion of the cross section of said tubular member, said arcuate section being in contact with said tubular member over the entire concave surface of said arcuate section, flange sections extending inwardly from adjacent the ends of said arcuate section, said flange sections being disposed in a longitudinal plane passing through the axis of said tubular member, said flange sections extending through and slidable along slots in the sidewall of said tubular member, said flange sections being selectively disposed completely within said tubular member and completely separable therefrom, said flange sections maintaining said arcuate section in contact with said tubular member, said flange sections and said arcuate section being a unitary structure, said flange sections including cutting sections diverging toward the free end of said tubular member; whereby an end of said marking stick can be sharpened by removing said stick from said tubular member, inserting one end of said marking stick into the end of said tubular member adjacent to said sharpening portion and rotating said stick with respect to said tubular member to cause the end of said stick to be sharpened as it contacts said diverging cutting sections.

2. Marker apparatus according to claim 1 wherein said flange sections are disposed in substantially the same plane.

3. Marker apparatus according to claim 1 wherein said clip member includes a finger section extending from said arcuate section longitudinally of said tubular member, said finger section extending from said arcuate section toward said retainer portion.

4. Marker apparatus according to claim 3 wherein said finger section of said sharpening portion is biased toward said tubular member.

5. Marker apparatus according to claim 1 wherein said retainer portion includes means for exerting pressure around substantially an entire circumferential section of said stick.

6. Marker apparatus according to claim 1 wherein said retainer portion includes a plurality of longitudinal slots on said tubular member.

7. Marker apparatus according to claim 1 wherein said retainer portion includes an externally threaded section on said tubular member and an internally threaded sleeve member engageable therewith.

8. Marker apparatus according to claim 1 wherein said soft material is soapstone.

9. Marker apparatus according to claim 1 wherein at least one of said body portion or retainer portion includes a grip section along the length thereof.

10. Marker apparatus according to claim 1 wherein said body portion, said retainer portion and said sharpening portion are formed of metal.

* * * * *